United States Patent [19]

Giamei et al.

[11] 4,375,375

[45] Mar. 1, 1983

[54] CONSTANT ENERGY RATE FORMING

[75] Inventors: Anthony F. Giamei, Middletown; Robert E. Doiron, East Haddam, both of Conn.

[73] Assignee: United Technologies Corporation, Hartford, Conn.

[21] Appl. No.: 315,598

[22] Filed: Oct. 30, 1981

[51] Int. Cl.[3] ..... C22F 1/10; C22F 1/18

[52] U.S. Cl. ..... 148/11.5 F; 148/11.5 N; 266/78; 266/89; 266/90; 266/99; 266/249

[58] Field of Search ..... 148/11.5 F, 11.5 N, 148/11.5 R, 12 R; 266/78, 89, 90, 99, 249, 115

[56] References Cited

U.S. PATENT DOCUMENTS

| | | | |
|---|---|---|---|
| 1,680,467 | 8/1928 | Matheson . | |
| 2,285,575 | 6/1942 | Elbertz | 78/45 |
| 2,345,353 | 3/1944 | Misfeldt | 113/46 |
| 2,389,425 | 11/1945 | Frost | 78/39 |
| 2,666,721 | 1/1954 | Bechtold et al. | 148/11.5 F |
| 2,736,085 | 2/1956 | Parre et al. | 29/1.3 |
| 2,738,571 | 3/1956 | Turnbull | 29/156.8 |
| 2,744,315 | 5/1956 | Fitzgerald | 29/553 |
| 2,778,064 | 1/1957 | Clark | 18/59.3 |
| 2,983,033 | 5/1961 | Cox | 29/159.01 |
| 3,025,905 | 3/1962 | Haerr | 153/32 |
| 3,258,834 | 7/1966 | Rork | 29/159.2 |
| 3,370,450 | 2/1968 | Scheucher | 72/354 |
| 3,398,444 | 8/1968 | Nemy | 29/159.2 |
| 3,514,989 | 6/1970 | Robinson | 72/377 |
| 3,519,503 | 7/1970 | Moore et al. | 148/11.5 |
| 3,550,417 | 12/1970 | McMaster | 72/57 |
| 3,660,177 | 5/1972 | Brown et al. | 148/11.5 N |
| 3,860,803 | 1/1975 | Levine | 235/151.1 |
| 3,975,219 | 8/1976 | Allen et al. | 148/11.5 N |
| 4,002,048 | 1/1977 | Pozsgay | 72/205 |
| 4,081,295 | 3/1978 | Vogel | 148/11.5 N |

*Primary Examiner*—W. Stallard

*Attorney, Agent, or Firm*—Charles E. Sohl

[57] ABSTRACT

An improved method for hot working materials previously considered to be difficult or impossible to hot work is described. The method consists of varying the deformation conditions in order to achieve an essentially constant energy input, to the material being worked, on a time basis.

6 Claims, 6 Drawing Figures

CONSTANT ENERGY RATE FORMING

The Government has rights in this invention pursuant to Contract No. F49620-80-C-0004 awarded by the Department of the Air Force.

DESCRIPTION

Technical Field

This invention relates to methods for hot working difficult to work metallic materials.

Background Art

The art of hot working materials is an ancient one. Only in recent years has the demand for high performance articles led to substantial studies of hot deformation processes and resultant improvements. Any hot deformation process may be described as deformation or strain as a result of applied load or stress. Hot working processes in which the deformation is preformed at a constant rate are well-known. In like fashion, processes in which the deformation rate is varied in order to produce a constant true strain rate (by taking into account the change in workpiece geometry) are known.

It is also known in the prior art to obtain improved forging or hot working results through the use of material pretreatment processes to produce enhanced ductility as described in U.S. Pat. No. 3,519,503. The present invention has obtained enhanced hot workability without the requirement of a pretreatment process.

Disclosure of Invention

It is an object of this invention to provide a process for the hot working of materials under conditions of constant energy input.

Yet another object is to provide a hot working process which can form materials without cracking and failure encountered in these materials in the process of the prior art.

Another object of the invention is to achieve equivalent deformation in the materials to those obtained in the prior art but at lower stress levels and without time penalties.

These objects are achieved by hot deforming metallic materials under conditions of constant energy input. Measurements of stress and strain are made on a regular basis during the hot deformation and from these measurements the area under the stress strain curve (which is proportional to the energy input to the workpiece) is calculated. The subsequent portion of the deformation process is controlled based on the prior history and is maintained at a constant energy input rate. Use of a constant energy input rate alleviates cracking in hard to work materials.

Other features and advantages will be apparent from the specification and claims and from the accompanying drawings which illustrate an embodiment of the invention.

BEST MODE FOR CARRYING OUT THE INVENTION

The present invention relates to the hot working or hot deformation of various hard to work materials. Hot working is performed at an elevated temperature, a temperature usually above the recrystallization temperature of the material. Thus, recrystallization occurs continuously as the process proceeds so that workhardening does not occur to any significant extent. The process of the invention has particular utility with respect to nickel base superalloys. Such alloys contains a substantial (20–70%) volume fraction of the gamma prime phase distributed as particles in the gamma prime matrix. The presence of such a large amount of the second phase inhibits recrystallization and the recrystallization temperature is usually found to be the same as the gamma prime solvus temperature which is the temperature above which the gamma prime phase goes into solution in the matrix.

Consistent with the performance of the process at an elevated temperature, it is necessary that hot dies be used in order to eliminate significant cooling of the workpiece. While the die temperature need not be exactly that of the workpiece, it should be reasonably close, i.e., within 100 and preferrably within 50° F. of the sample temperature. It is also desirable to perform the process in a nonoxidizing atmosphere in order to eliminate oxidation which can have a detrimental effect on the success of the process.

Figure 1:
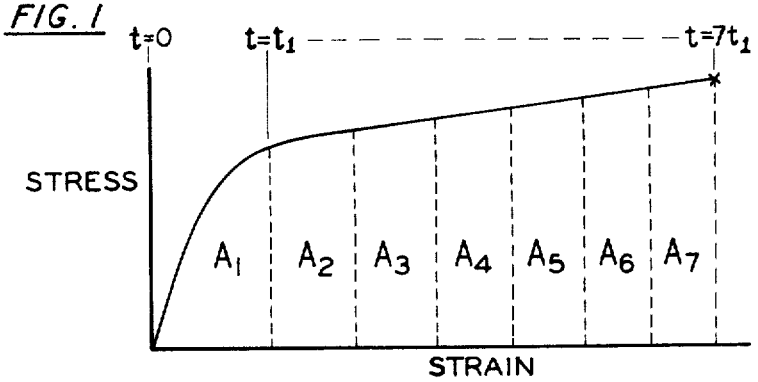
FIG. 1 is a schematic stress strain curve.

The invention may be broadly understood through consideration of FIG. 1 which is representative of a stress-strain curve for metallic materials. It is comprised of an initial steep linear portion (the elastic portion) followed by a subsequent portion of diminished slope and linearity (the plastic portion). In the past many material forming operations have been performed at a constant displacement rate or strain rate. Both constant engineering strain rate and constant true strain rate processing have been utilized. Constant engineering strain rate processing is also referred to as constant displacement rate processing.

The essence of the present invention is the performance of hot working operations under isothermal conditions and in a manner such that, as the stress-strain condition of the material moves along the curve the area swept out under the curve is essentially constant with respect to time. That is, $A_n = A_{n+1}$. As is known to those skilled in the art, the area under the stress strain curve is reflective to the amount of energy imparted to the material. Thus the present invention comprises the hot working of materials in such a way that the energy input to the workpiece is essentially constant with respect to time.

Through the present invention, it is possible to hot work materials which previously could not be consistently hot worked. These materials may be generally described as the superalloys (Fe, Ni and Co based) titanium alloys, tool steels and refractory metals. The method of the present invention is also generally applicable to all types of hot working processes including those which are tensile, compressive, shear and torsion based. The method has particular applicability to the compressive hot working ("upset" forming) of superalloys and will be explained with reference thereto. The method is an isothermal one, performed using dies heated to essentially the working temperature of the alloy and a preform or billet heated essentially the same temperature.

Figure 2:
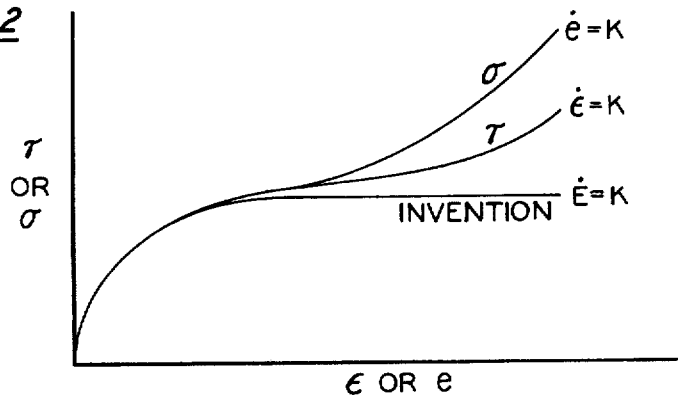
FIG. 2 shows a stress strain curve with the same data plotted in different ways.

FIG. 2 shows, in schematic form, stress-strain curves plotted using different parameters. The symbol $\tau$ denotes the true stress which is determined by dividing the force applied by the instantaneous cross sectional area of the workpiece. The symbol $\sigma$ denotes the engineering stress which is determined by dividing the applied stress by the initial area of the specimen. At low levels of deformation true stress and engineering stress are essentially equivalent because the sample area changes only slightly. In a similar manner, $\epsilon$ denotes the true strain which is the integral of dl/l and is equivalent to ln $(l/l_o)$ and e is the engineering strain which is calculated based on the change in length divided by the original length. FIG. 2 shows the curves resulting from the plotting of the same data in different forms. The curve marked $\dot{E}=K'$ represents the invention where $\dot{E}$, the energy input rate is held constant.

The result of the present invention is that a given amount of strain can be imparted at a lower average and lower maximum stress level than those levels required in the prior art. Intuitively, it can be appreciated that a material will likely crack upon exceeding a particular applied stress and a process able to achieve the same strain at a lower maximum stress level will likely alleviate cracking. It may be true that one could achieve the same result by reducing the strain rate to a very low value and in fact this process is employed in certain circumstances and is known as creep forming. For various technical reasons, such a process may not always produce a desirable result and in any event such a process takes an excessive amount of time. The present invention produces the desired deformation in a short period of time without cracking.

While the inventive process can be performed in a variety of ways, these methods all rely on the use of the prior stress-strain-time history of the workpiece to predicting what the future stress-strain-time history should be to arrive at the desired constant energy input rate. However, with reference to FIG. 1, it is apparent that while $A_3$ can be used to predict $A_4$ or $A_5$, $A_1$ is not predictive of $A_2$ because of the substantial change in the stress-strain curve shape which occurs during $A_1$. For this reason, the initial part (i.e., about 0.2%–10% strain) of the invention process is performed under conditions of constant strain rate (either engineering strain rate or true strain rate). However, FIG. 2 illustrates that this is not a serious compromise because at low strain values, all the curves coincide.

Figure 3:
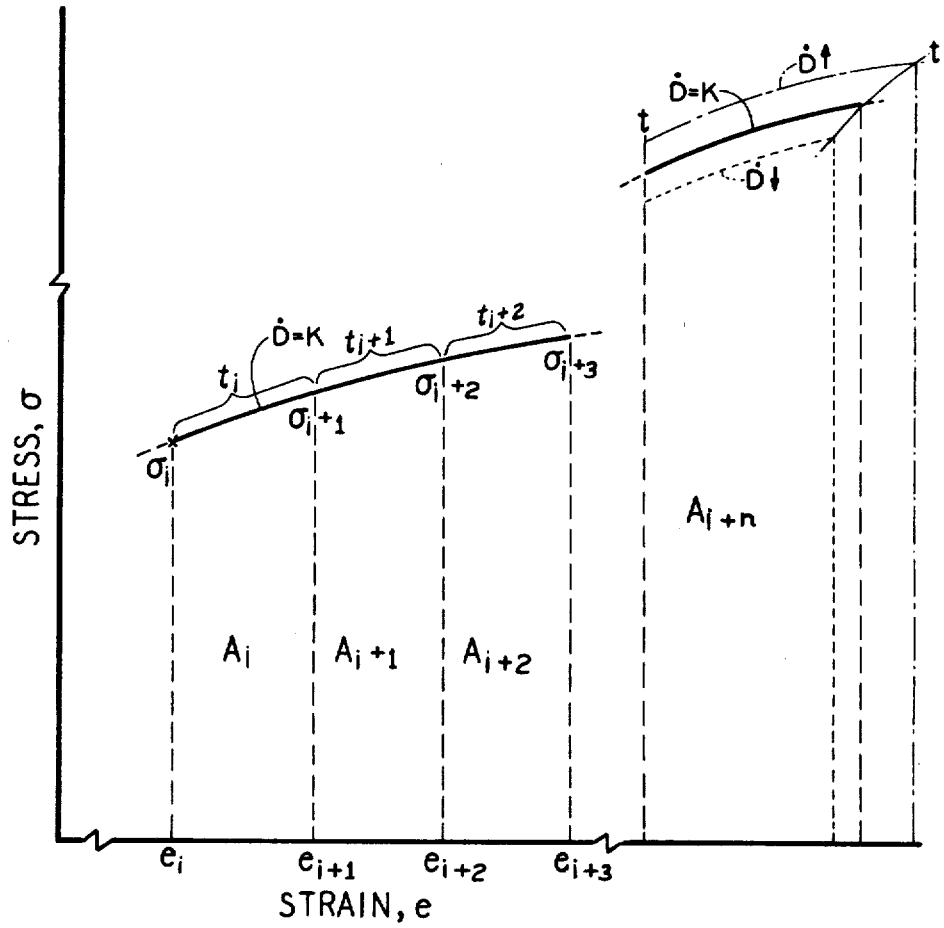
FIG. 3 is a portion of the schematic stress strain diagram illustrating one method for performing the invention.

A more detailed explanation of the invention may be derived from FIG. 3 and the discussion which follows. FIG. 3 shows a part of the stress strain curve, which sets forth the stress and strain in the material during the deformation process. It will be appreciated that a time scale may also be marked on the curve. With specific reference to FIG. 3, the stress and strain conditions $\sigma$ and e are shown over different time intervals t. Thus for example over time $t_i$, the stress in the material increases, from $\sigma_i$ to $\sigma_{i+1}$ while the strain increases from $e_i$ to $e_{i+1}$ thus the area under the curve can be calculated to a sufficient degree of accuracy as:

$$A_i = \left(\frac{\sigma_i + \sigma_{i+1}}{2}\right) \cdot (e_{i+1} - e_i)$$

This area can be computed only at the completion of time interval $t_i$ and cannot therefore be used to modify the immediately subsequent time interval $t_{i+1}$. Instead, the information derived during $t_i$ is used to vary the deformation rate during $t_{i+2}$ so that the area $A_{i+2}=A_i$.

It will be appreciated that only variable in the process is the displacement rate $\dot{D}$ of the ram or die which is deforming the material. Consideration of the righthand portion of the FIG. 3 shows that varying the displacement rate $\dot{D}$ produces two effects. The most obvious effect is to decrease the amount of strain achieved in a particular time interval. This is depicted in the shifting of the vertical lines in the figure. However, it is also known that changing the strain rate of deformation changes the stress or resistance to deformation of the material. The strain rate sensitivity is denoted as m which is derived as follows:

$$\frac{dl\sigma}{dl\dot{e}} = m$$

m is a material property which varys only slightly with temperature and strain. For the case of fine grain ($\sim 10^2$ micron grain size) nickel base superalloys m is about $0.6\pm0.1$, while the coarser grain size nickel base superalloys ($\sim 10^3$ micron grain size), m is about $0.25\pm0.1$. The relationship between $\dot{D}$ and $\dot{e}$ is known and thus knowing D and m can be predicted. Using a digital computer then, for the time period $t_{i+2}$, $\dot{D}$ can be varied such at $A_{i+2}=A_i$, thus resulting in a constant energy input rate to the workpiece.

We believe that substantial benefits will result if the energy input is held constant within $\pm10\%$ of a nominal value and preferrably within $\pm5\%$ of a nominal value.

It is well-known that for a stress-strain curve such as those shown in FIG. 1, if a material is loaded into the plastic region and then unloaded, upon unloading the material condition will return to a zero stress condition along a line parallel to the original elestic portion of the curve. In other words even when a material has been severely plastically deformed it still contains a predictable amount of recoverable elastic energy. We believe that in the present invention the constant energy input should, in theory, actually be a constant plastic energy input. This would mean that the dotted lines separating the various areas in FIG. 1 should actually be sloped towards the origin parallel to the initial elastic portion of the stress strain curve. However, this is of only theoretical importance since for any reasonable amount of total strain the elastic component will be insignificant.

Figures 4A, 4B, 4C:
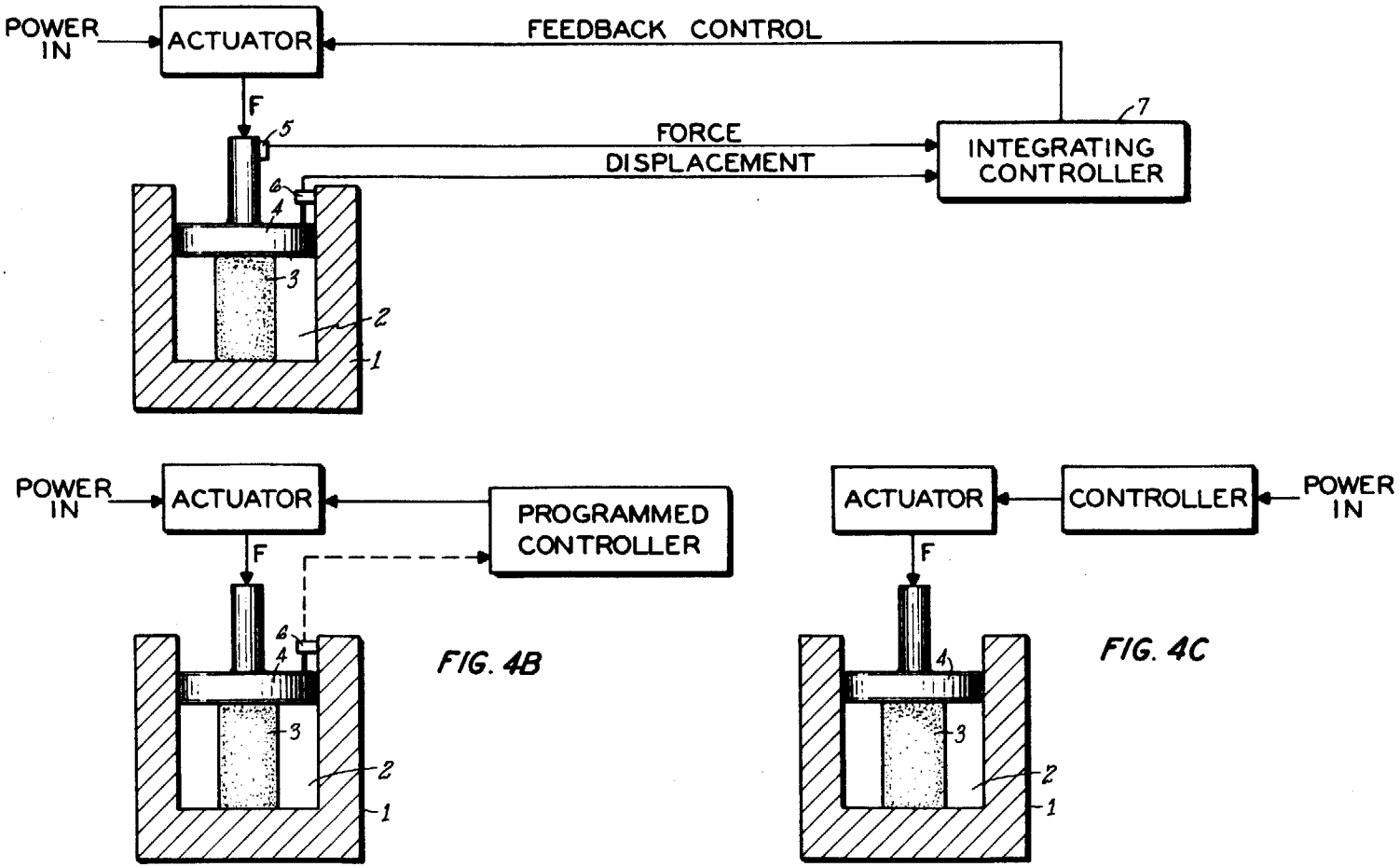
FIGS. 4A, 4B and 4C illustrate alternative mechanisms for performing the process of the invention.

FIGS. 4A, 4B and 4C show three alternative pieces of apparatus for working metal according to the present invention. FIG. 4A shows a hot working apparatus consisting of a base and frame member 1 having a cavity 2 therein which contains workpiece 3. Moveable ram 4 is arranged so that it can deform the workpiece upon application of force F provided by actuating means. The actuating means may be for example, hydraulic means or any mechanical means. In FIG. 4A the ram assembly 4 has attached thereto load sensing means, for example, a strain gage for sensing the applied load, and displacement sensing means 6 which may be, for example, a linear voltage displacement transformer, for sensing the position of the ram 4. The output from the strain sensing means and the displacement sensing means are proportional to the force applied and displacement of the ram. Such signals may be combined in an integrating controller 7 which produces an output signal which is representative of the area under stress strain curve. This signal is then used to control the subsequent motion of the actuator. In operation the actuator is programmed initially to follow a path of constant strain rate deformation (it will be recalled that the difference between constant strain rate deformation (whether engineering or true strain rate) and constant energy rate deformation is initially insignificant, for example for strain levels less than about 10%). The integrating controller 7 thereafter operates on a predetermined schedule, i.e., constant time period or constant strain period and controls subsequent ram displacement based on the prior energy input history to achieve the desired subsequent constant energy input rate. The apparatus described in FIG. 4A is the most precise and flexible apparatus for performing the invention process, however particularly for the repetitive or production forming of parts, a less complex apparatus may be used such as that in FIG. 4B. In FIG. 4B the mechanical aspects of the apparatus are similar to that of FIG. 4A, however the signal for the actuator is provided by a preprogrammed controller. The information necessary to program the controller could be derived from the apparatus shown in FIG. 4A. The program might run strictly as a function of time or it could alternatively operate in response to a displacement signal from a displacement sensing means 6 such as that previously described. FIG. 4C is yet another alternative. Again the mechanical apparatus are essentially unchanged. In FIG. 4C the principle of operation is to directly monitor the energy input to be constant with respect to time. The implementation of this embodiment is somewhat more complex however, and requires that the power input to run the apparatus without a workpiece be known and this power input be subtracted from the actual observed input to provide a useful indication of the energy actually used to deform the workpiece.

EXAMPLE 1

Specimens of a modified IN 100 composition (nominal composition 12% Cr, 18% Co, 3.2% Mo, 4.3% Ti, 5% Al, 0.8% V balance nickel) were produced from a billet which had been produced from powder by hot isostatic pressing. The specimens were rectangular parallelepipeds with a 2:1 aspect ratio and a square cross section. These specimens were reduced 60% in height at several temperatures.

Deformation was accomplished in a hydraulic testing apparatus controlled by a programmable controller. Heated ceramic dies were used and a vacuum atmosphere was maintained. The controller was programmed to operate in accordance with the following scheme:

a. An initial displacement schedule that would achieve a condition of essentially contant strain rate deformation was calulated. A strain rate of 0.17%/sec or 10%/min was selected.

b. Forming was performed according to this schedule until 1% strain was achieved. Subsequent deformation was performed in increments of constant strain (2% strain per increment), and the time to achieve the constant strain increment was the variable. Each time interval was computed as follows:

$$t_{i+1} = t_i\left(\frac{P_{i+1}}{P_i}\right)$$

where $P_{i+1}$ is determined by extrapolation from $P_{i-1}$ and $P_i$ and where $P_{i=1}$ is the load measured at center of the strain increment (i.e., at 2%, 4% etc. strain)

so that $$\frac{P_{i+1}}{t_{i+1}} = \frac{P_i}{t_i} \text{ or } \frac{P_{i+1}}{A}\left(\frac{\Delta l}{\Delta t}\right)_{i+1} = \frac{P_i}{A}\left(\frac{\Delta l}{\Delta t}\right)_i$$

which in turn means that $$(\sigma\dot{\epsilon})_{i+1} = (\sigma\dot{\epsilon})_i$$

implying that $$\frac{d}{dt}(\sigma\epsilon) = \frac{d}{dt}(\tau\epsilon) = \text{constant rate of energy input}$$

Figure 5:
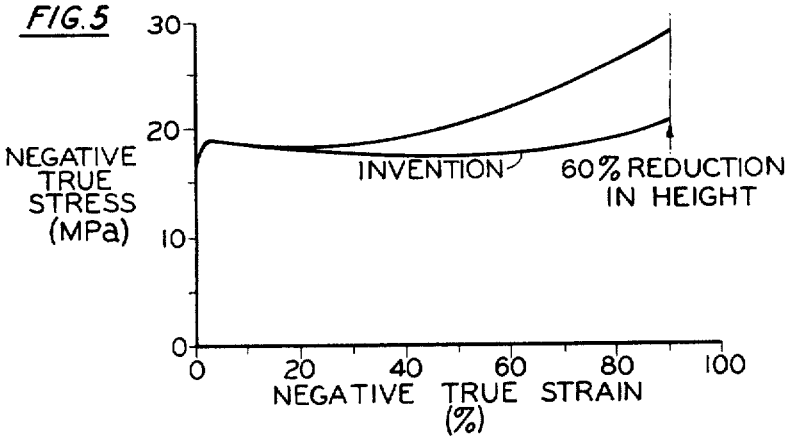

FIG. 5 shows true stress - true strain curves for identical samples deformed, at 1070° C., under conditions of constant energy input and constant displacement rate. The energy input rate was 0.038 MPA/sec. It is apparent that by employing conditions of constant energy input the reduction was achieved without exceeding a stress of about 20 ksi while under conditions of constant displacement rate a maximum stress of about 29 ksi was required.

The nickel base superalloys may be divided into three categories based on gamma prime content. The "lean" alloys contain less than about 30%, by volume, of the gamma prime phase. These alloys generally quite workable and are worked below the gamma prime solvus. The intermediate alloys contain from about 30 to about 50%, by volume, of the gamma prime phase. These alloys are quite difficult to work and are again worked below the gamma prime solvus temperature. Finally, the "rich" alloys contain greater than about 50% by volume, of the gamma prime phase and are generally considered to be unworkable except in the super plastic condition which is achieved through powder metallurgy procedures. However, the present invention can be used to hot work cast rich (non superplastic) superalloys above their gamma prime solvus. The invention process will generally be performed in accord with the preceding guidelines when applied to nickel base superalloys.

Preliminary indications are that superior results can be obtained, in the case of the "rich" alloys, by initially forming above the gamma prime solvus and during the forming process decreasing the temperature to below the solvus temperature. This provides formability in combination with a desirable fine final grain size.

It should be understood that the invention is not limited to the particular embodiments shown and described herein, but that various changes and modifications may be made without departing from the spirit and scope of this novel concept as defined by the following claims.

We claim:

1. A method for hot working materials selected from the group consisting of iron base superalloys, nickel base superalloys, cobalt base superalloys, titanium alys, tool steels and refractory metals, which comprises ıt working the material using dies which have been ated to the working temperature using a deformation te which is adjusted so that the energy input the ɔrkpiece is substantially constant with respect to time.

2. A method as in claim 1 in which the load applied to ɜ material and the deformation of the material are egrated to produce an output signal which is proporate to the energy input, said output signal being used control the subsequent deformation of the material.

3. A method as in claim 1 in which the deformation is ntrolled by a preprogrammed controller so that the formation proceeds at a constant energy rate.

4. A method as in claim 1 in which the energy input the forming apparatus is monitored and controlled in such a fashion that the energy input to the material is maintained at a constant rate.

5. In a method for hot working nickel base superalloy articles which comprises hot working the articles using dies which have been heated to the working temperature at a constant strain rate for an initial amount of from about 0.2 to about 10% strain and subsequently working the articles under conditions of constant energy input.

6. In an apparatus for hot working metal articles, the improvement which comprises stress sensing means, strain sensing means, and control means which integrate the prior stress and strain history of the material and controls this subsequent working of the material so that said subsequent working occurs under condition of constant energy input to the article.

* * * * *